US005279017A

United States Patent [19]

Foreshew

[11] Patent Number: 5,279,017

[45] Date of Patent: Jan. 18, 1994

[54] METHOD AND APPARATUS FOR EXTRACTING PARTICLES FROM CONTAINERS

[75] Inventor: Alan L. Foreshew, Dingley, Australia

[73] Assignee: Kraft Foods Limited, Port Melbourne, Australia

[21] Appl. No.: 745,644

[22] Filed: Aug. 15, 1991

[51] Int. Cl.[5] ..... B08B 5/04

[52] U.S. Cl. ..... 15/304; 15/309.2; 15/345

[58] Field of Search ..... 15/304, 345, 346, 353, 15/306.1

[56] References Cited

U.S. PATENT DOCUMENTS

| | | | |
|---|---|---|---|
| 1,448,255 | 3/1923 | Capell | 15/304 X |
| 1,880,257 | 10/1932 | Kiefer | 15/304 X |
| 2,073,746 | 3/1937 | Keller | 15/304 |
| 2,644,188 | 7/1953 | Pacilio | 15/304 |
| 2,917,768 | 12/1959 | Walberer | 15/304 |
| 3,268,942 | 8/1966 | Rossnan | 15/346 |
| 3,484,890 | 12/1969 | Case | 15/346 |
| 4,017,330 | 4/1977 | Aidlin et al. | 15/304 X |
| 4,162,149 | 7/1979 | Mekelburg | 15/353 X |
| 5,078,548 | 1/1992 | Hyden et al. | 15/345 |
| 5,099,542 | 3/1992 | Frye et al. | 15/306.1 X |

FOREIGN PATENT DOCUMENTS 977910 11/1975 Canada ..... 15/346

*Primary Examiner*—Chris K. Moore
*Attorney, Agent, or Firm*—Linn I. Grim

[57] ABSTRACT

A method and apparatus for extracting particles from containers. The method comprises the steps of conducting high pressure air from a source thereof and into the containers to loosen the particles from the containers, and connecting the containers to a low pressure source to withdraw air and loose particles from containers. The apparatus comprises a source of pressurized air, and a high pressure line connected to that source to conduct the pressurized air to the containers to loosen the particles from the containers. The apparatus further comprises a low pressure source, and a low pressure line to connect the containers to the low pressure source to withdraw air and the particles from the containers. Preferably, in both the method and apparatus, the containers are moved beneath one or more caps that are used to generally close the tops of the containers, and each cap is connect to both the high and low pressure sources. With this preferred arrangement, high pressure air is conducted through the cap and into the containers to loosen particles therein, and the containers are connected to the low pressure source by connecting the cap to that source to withdraw air and particles from the containers via the cap.

6 Claims, 4 Drawing Sheets

METHOD AND APPARATUS FOR EXTRACTING PARTICLES FROM CONTAINERS

BACKGROUND OF THE INVENTION

This invention generally relates to methods and apparatus for extracting particles from containers; and more specifically, to such methods and apparatus that are particularly well suited for extracting particles from breakable food containers.

Various food materials are sold in breakable containers such as glass jars; and occasionally such a container may break while the container is initially being filled with the food material, or while the container is being handled. Such breakage is undesirable not only because the broken containers must be replaced but also because fragments or particles of the broken containers may fall or otherwise enter other containers; and when this happens, those fragments or particles of must be removed from those other containers.

Numerous procedures are well known that very effectively remove or extract the broken particles from the other containers; and for example, this may be done by inverting and then washing those other containers before they are filled with product. These particle extraction procedures, although highly effective, have a disadvantage in that the procedures themselves may case additional containers to break.

SUMMARY OF THE INVENTION

The present invention relates to a method and apparatus for extracting particles from containers. The method comprises the steps of conducting high pressure air from a source thereof and into the containers to free any particles from the container walls, and connecting the containers to a low pressure source to withdraw air and the now loose particles from the containers. The apparatus comprises a source of pressurized air and a high pressure line connected to that source to conduct the pressurized air to the containers to loosen the particles from the containers. The apparatus further comprises a low pressure source, and a low pressure line to connect the containers to the low pressure source to withdraw air and the particles from the containers. Preferably, in both the method and apparatus, the containers are moved beneath one or more caps that are used to generally close the tops of the containers, and each cap is connected to both the high and low pressure sources. With this preferred arrangement, high pressure air is conducted through the cap and into the containers to loosen particles therein, and the containers are connected to the low pressure source by connecting the cap to that source to withdraw air and particles from the container via the cap. By the provision of multiple hoods supplied with different pressures, particles of particular sizes and weights can be selectively extracted from the container at each head.

Further benefits and advantages of the invention will become apparent from a consideration of the following detailed description given with reference to the accompanying drawings, which specify and show preferred embodiment of the invention.

DETAILED DESCRIPTION OF THE PREFERRED EMBODIMENTS

Figure 1:
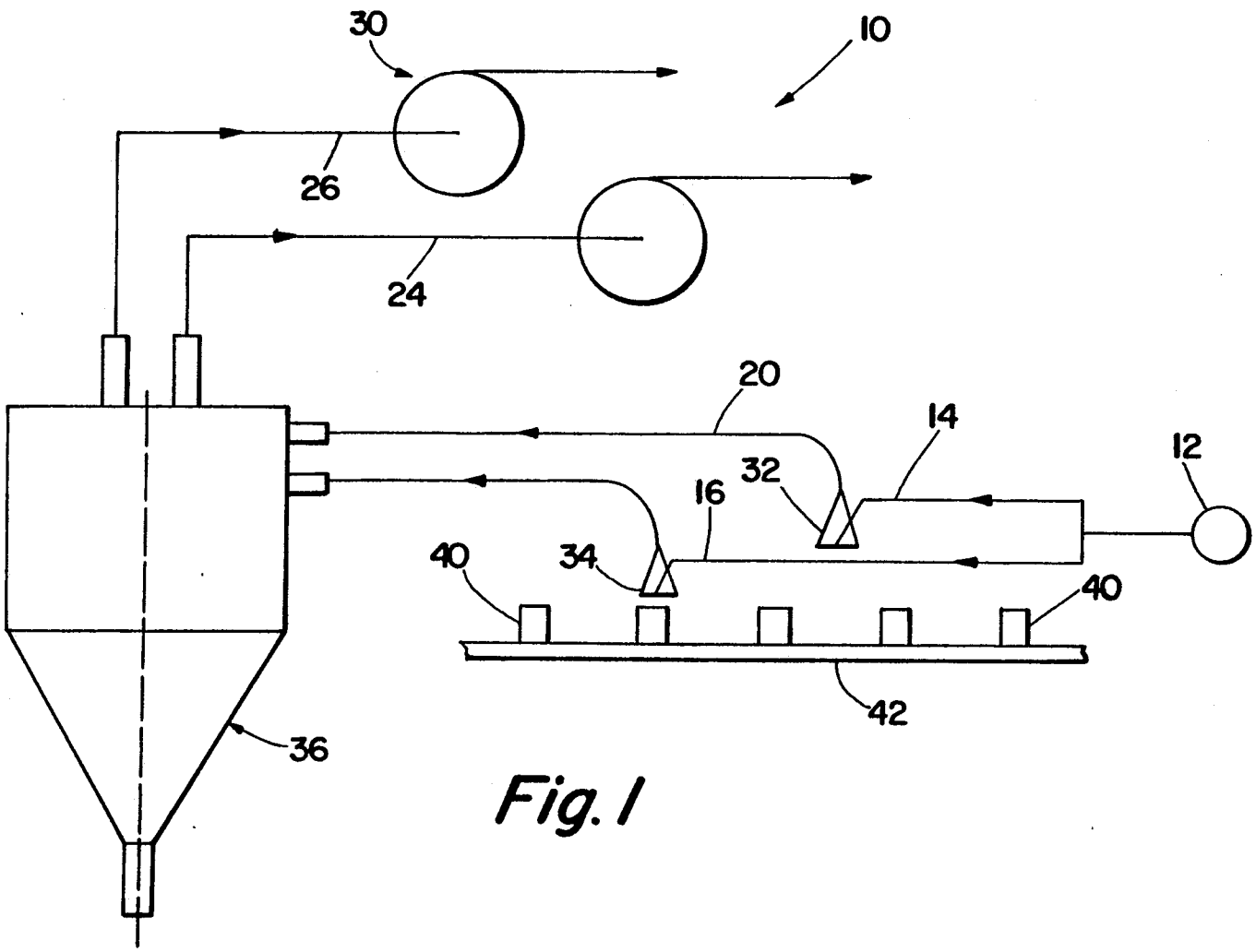
FIG. 1 is a flow diagram illustrating a preferred particle extraction method and apparatus of this invention.
Figure 2:
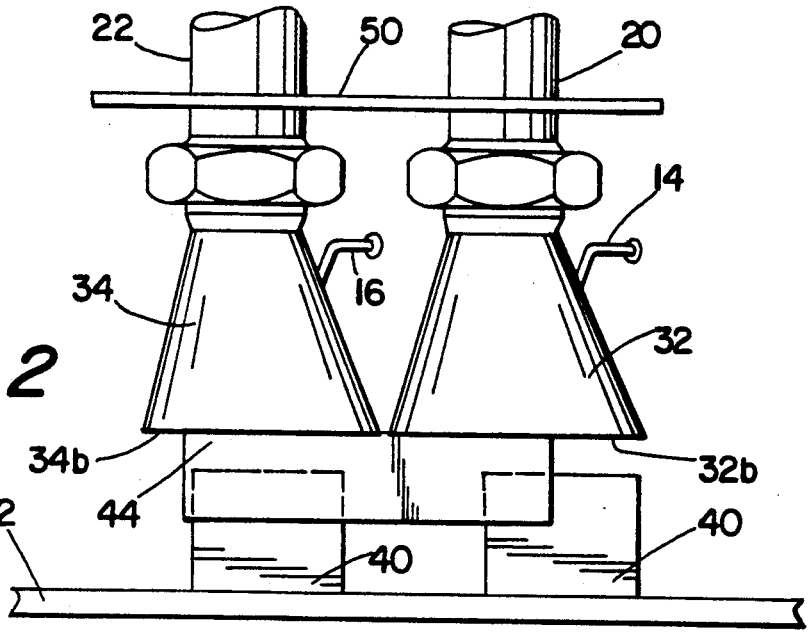
FIG. 2 is a side elevation view of two container caps of the system shown in FIG. 1.
Figure 3:
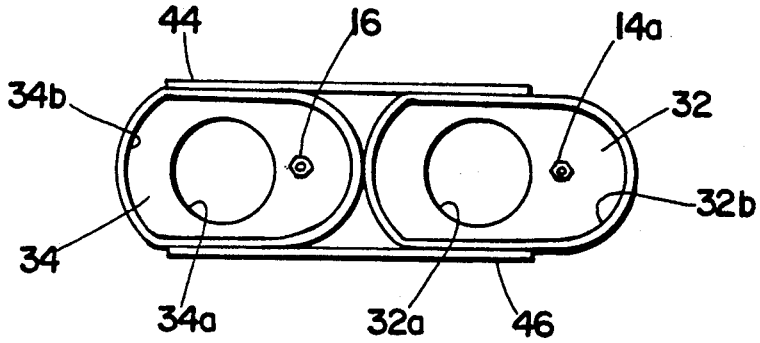
FIG. 3 is a bottom view of the caps shown in FIG. 2.
Figure 4:
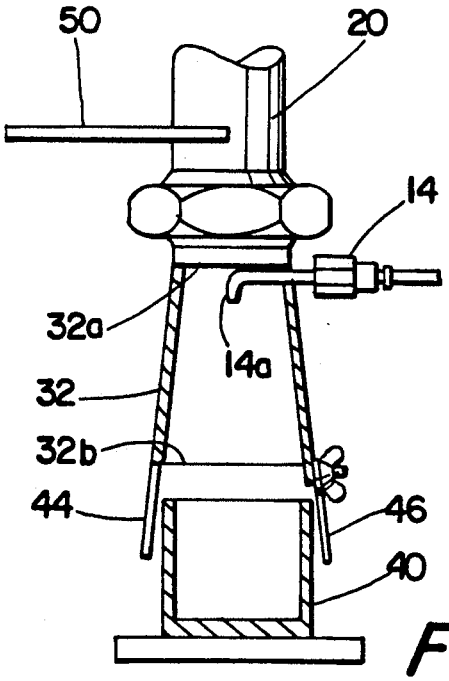
FIG. 4 is a side cross-section view through one of the container caps illustrated in FIG. 2.
Figure 5:
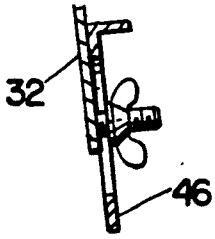
FIG. 5 is an enlarged view of a portion of FIG. 4.

FIG. 1 illustrates particle extraction system 10 generally comprising a source 12 of high pressure air, high pressure lines 14 and 16, low pressure lines 20, 22, 24, and 26, and a low-pressure source 30, and preferably system 10 further comprises a pair of caps 32 and 34 and particle separator 36. FIG. 1 also schematically shows a multitude of containers 40 mounted on conveyor belt 42 that carries the containers past extraction system 10, specifically caps 32 and 34.

System 10 is particularly well suited for use in conjunction with a food processing or handling system in which, among other things, containers 40 are filled with a food product or material. For the sake of simplicity, the related food processing or handling system is not shown in the drawings. As containers 40 move through the food processing system, on rare occasions one of those containers may break and fragments or pieces of the broken container may enter other containers 40, and system 10 is provided to remove those broken fragments or pieces from the container 40.

In the operation of system 10, generally, containers are moved past the extraction system, specifically caps 32 and 34. As this occurs, high pressure lines 14 and 16 are used to conduct pressurized air from source 12 into containers 40 to loosen any particles that might be in the container, and then low pressure lines 20, 22, 24, and 26 are is used to connect the containers to low pressure source 30 to withdraw from the containers 40 air and any particle fragments that might be in the containers.

Preferably, each cap 32, 34 is connected to one of the low pressure lines and one of the high pressure lines; and as containers 40 move along conveyor 42, each container comes directly beneath one or both of the caps 32, 34, with the top, open end of each container coming immediately below the bottom open end of one or both of the caps. With this arrangement, each time one of the containers is located directly below one of the caps, first, high pressure air is conducted through a high pressure line, through that one cap, and into the container below that cap, and second, one of the low pressure lines is used to draw any particles out from that container.

With the preferred embodiment of system 10 illustrated in FIG. 1, each container 40 is moved beneath both caps 32 and 34 in series, and both caps are used to extract particles from each of the containers. As will be understood by those of ordinary skill in the art, using two caps in series, or even using two caps, to extract particles from containers 40 is not necessary to the practice of this invention; and, for example, system 10 may be provided with only one cap, with a single high pressure line connecting that cap to high pressure source 12, and with a single low pressure line connecting that cap to low pressure source 30. In addition, preferably, the containers 40 move continuously past the caps 32 and 34, although this also is not necessary; and, if desired, each container may be temporarily stopped for a short period of time directly below one or both of the caps. If the containers are stopped below caps 32 and 34, then it may be desirable to mount the caps directly on, or to connect the caps releasably to, the containers.

With reference to FIGS. 2–5, each cap 32, 34 preferably includes a side wall and, in addition, a pair of baffles 44 and 46 are connected to opposite, lateral sides of the caps. The side wall of each cap has the general shape of a truncated cone, although, as particularly shown in FIG. 3, the horizontal cross sections of the caps have an approximately elongated elliptical shape. Each cap includes top and bottom openings; and the top and bottom openings of cap 32 are referenced at 32*a* and 32*b*, respectively, while the top and bottom openings of cap 34 are referenced at 34*a* and 34*b*, respectively. A respective one of the low pressure lines is connected to the top opening of each cap, around that top opening; and in particular, line 20 is connected to cap 32 around opening 32*a*, and line 22 is connected to cap 34 around opening 34*a*.

The bottom opening of each cap is located at a level slightly above the tops of containers 40 as those containers move past the caps. A respective one of the high pressure lines 14, 16 extends through the side wall of each of the caps 32, 34 and into the interior thereof, and each of the high pressure lines includes a downwardly extending forward outlet portion 14*a*, 16*a* to direct the high pressure air downward into a container moving beneath the cap. Again with particular reference to FIG. 3, the outlet of each high pressure line is centered inside each cap at a position that is, relative to the direction in which containers 40 move past caps 32 and 34, rearward of the center of the cap; and the inlet of each low pressure line is centered at a position that is, again relative to the direction in which containers 40 move past caps 32 and 34, slightly forward of the center of the cap.

Baffles 44 and 46 are connected to lower portions of caps 32 and 34 and extend downward therefrom, on both sides of the path of travel of containers 40 past the caps, to help enclose those containers as they move beneath the caps. In this way, Baffles 44 and 46 help to increase, first, the efficiency with which the high pressure air loosens any particles in containers 40, and second, the efficiency with which low pressure lines 20 and 22 draw any such particles from the containers. In addition, a plate 50 is preferably connected to lower portions of low pressure lines 20 and 22, at a location slightly above the inlets thereof. Plate 50 may be connected to an adjacent support member to hold the lower portions of lines 20 and 22 and caps 32 and 34 in place relative to conveyor 42, or plate 50 may be used to move the lower portions of lines 20 and 22 and caps 32 and 34.

Figure 6:
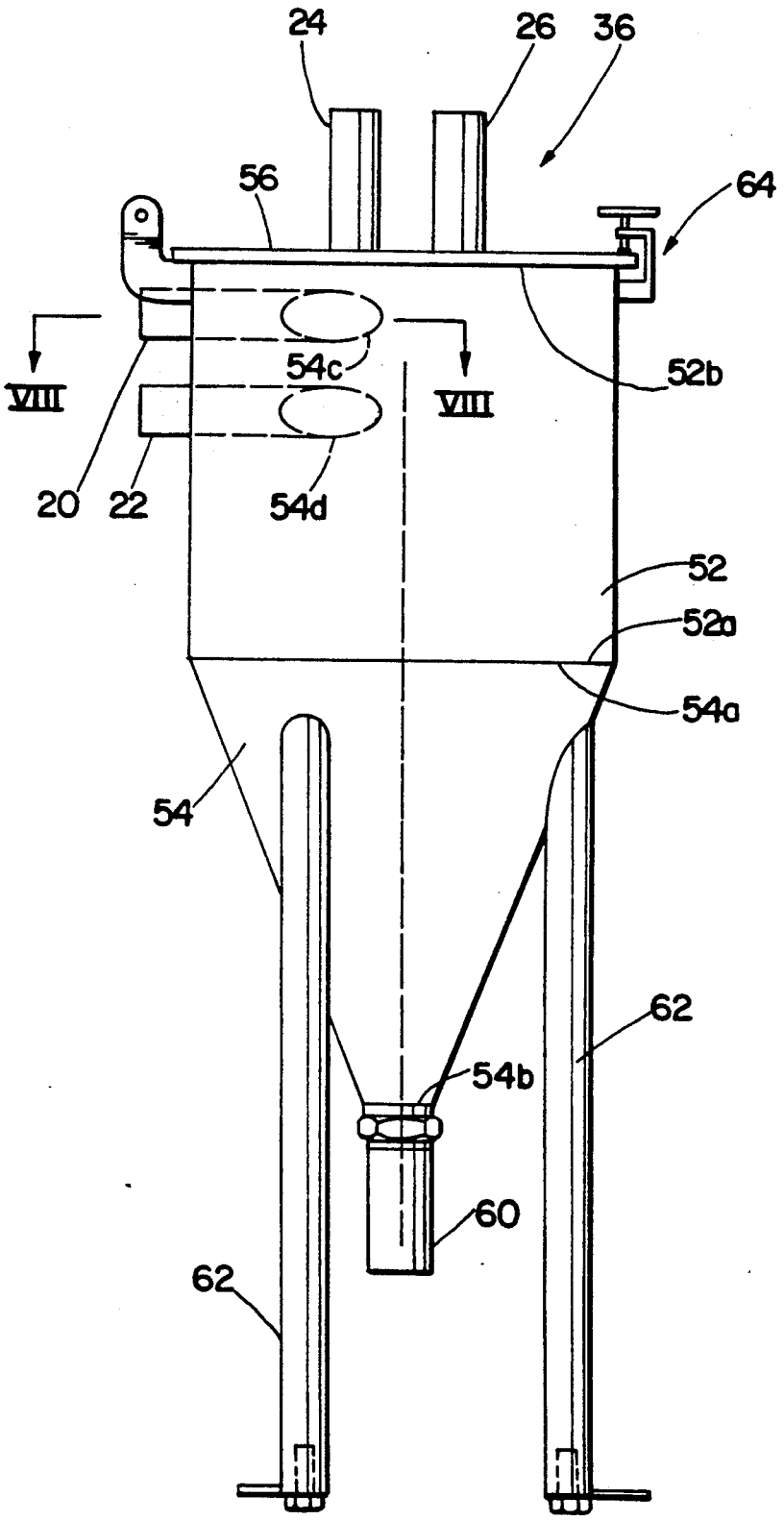
FIG. 6 is a side elevation view of the particle separator used in the system of FIG. 1.

With reference to FIGS. 1 and 6, separator 36 is located between containers 40 and low pressure source 30 to receive air and any withdraw particle fragments from containers 40, and to separate those particles from that received air; and, generally, separator 36 includes upper section 52, lower section 54, top cover 56, particle outlet 60, and a plurality of legs 62.

Upper separator section has the shape of a hollow cylinder, and lower separator section 54 has the shape of a hollow, truncated cone. The lower edge 52*a* of section 52 and the upper edge 54*a* of section 54 are coterminus and are connected together, and the lower separator section extends downward from the upper separator section coaxial therewith. Bottom edge 54*b* of lower section 54 defines an outlet to discharge particles from the lower separator section, and discharge tube 60 is connected to lower separator section, around that outlet, to conduct particles therefrom. Legs 62 are connected to and are spaced around lower separator section 54 and extend downward therefrom to the ground, floor, or another surface to support the particle separator 36 thereon. An adjusting bolt may be provided at the bottom end of each leg 62 to allow the height of each leg to be adjusted to help insure that separator 36 is maintained in the preferred orientation—preferably, with the axis of the separator substantially vertical.

Figure 8:
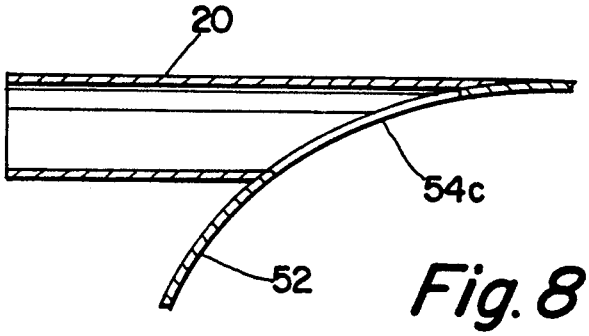
FIG. 8 is an enlarged cross-sectional view of a portion of the particle separator, taken along Line VIII—VIII of FIG. 6.

Upper separator section 52 forms two inlets 52*c* and 52*d* and each of the low pressure lines 20 and 22 is connected to the upper separator section, around a respective one of those inlets 52*c* and 52*d*, to conduct particles and air into the particle separator from containers 40. With particular reference to FIG. 8, preferably each of the low pressure lines 20 and 22 is connected to upper separator section 52 substantially tangential thereto, so that the low pressure line conducts air and particles into the upper separator section in a direction substantially tangential thereto.

Cover plate 56 is provided to substantially close the top of upper separator section 52, and this cover plate also forms outlets 56*a* and 56*b* for discharging air from the particle separator. More specifically, cover plate 56 has a substantially flat disc-shape and is mounted and supported on top edge 52*b* of upper separator section 52, and the cover plate extends across that edge, substantially perpendicular to the axis of particle separator 36. Low pressure lines 24 and 26 are connected to cover plate 56, around outlets 56*a* and 56*b*, respectively.

Figure 7:
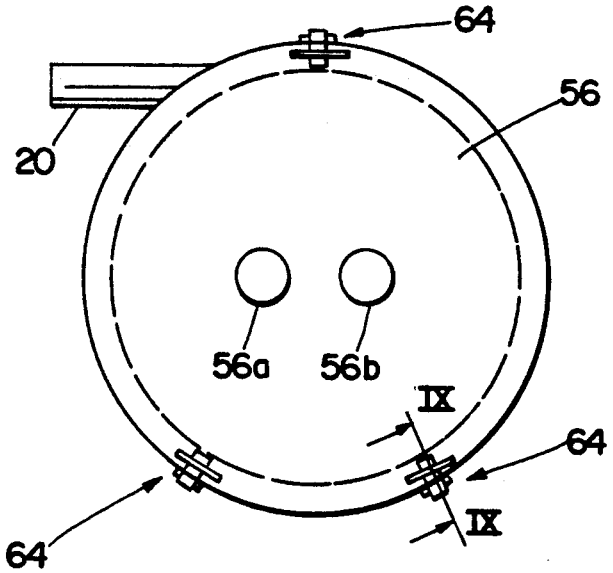
FIG. 7 is a top plan view of the particle separator.

Plate 56 is releasably connected to upper separator section 52, and any suitable means may be employed to do this. For example, with reference to FIGS. 6 and 7, a plurality of connecting assemblies 64 may be connected to upper separator section 52, adjacent and spaced around upper edge 52*b* thereof, to releasably hold cover plate 56 thereon.

Figure 9:
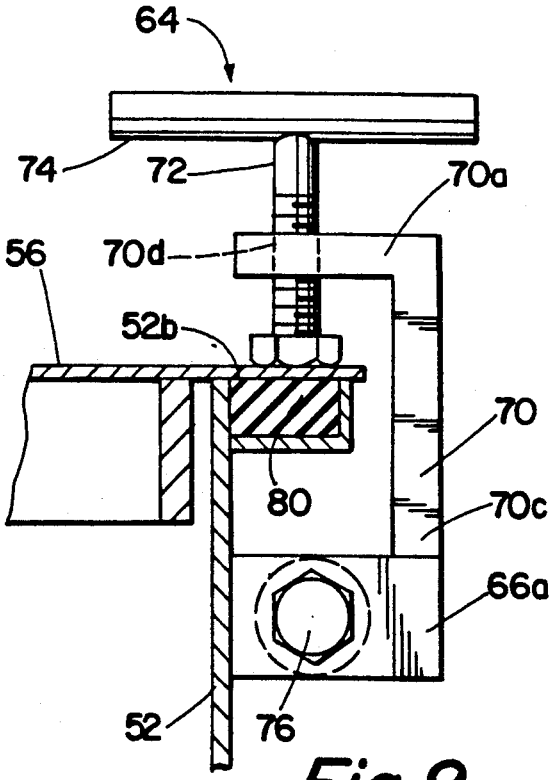
FIG. 9 shows one of the connecting assemblies of the particle separator and is taken along Line IX—IX of FIG. 7.
Figure 10:
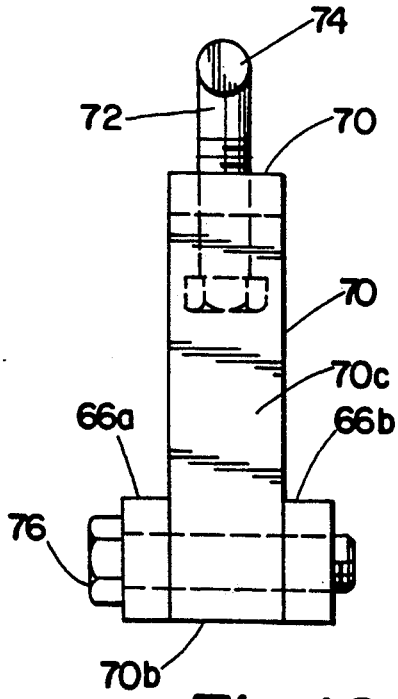
FIG. 10 is a side view of the connecting assembly shown in FIG. 9.

Connecting assemblies 64 are substantially identical to each other, and thus only one will be described herein in detail. With particular reference to FIGS. 9 and 10, each assembly 64 includes a pair of connecting arms 66*a* and 66*b*, a hook member 70, clamping bolt 72, and handle 74. Arms 66*a* and 66*b* are rigidly connected to upper separator section 52, adjacent and spaced below top edge 52*b* thereof, and arms 66*a* and 66*b* extend outward from separator section 52, parallel to each other. A bolt 76 is connected to and extends across arms 66*a* and 66*b*, and hook member 70 is mounted on bolt 76 for pivotal movement toward and away from top edge 52*b* of separator section 52.

Hook member 70 has the shape of a backwards "C", and includes top and bottom leg portions 70*a* and 70*b* and base portion 70*c*. More specifically, top and bottom leg portions 70*a* and 70*b* are connected to and extend outward from top and bottom ends, respectively, of base portion 70*c*. Bottom leg portion 70*b* forms a through opening and is pivotally mounted on bolt 76, which extends through that through opening. Top leg portion 70*a* forms a threaded through opening 70*d*, and clamping bolt 72 extends through that opening and engages the threads thereof. Handle 74 is connected to bolt 72 to rotate the bolt and thereby to move the bolt through opening 70*d*.

Hook member 70 is pivotally supported by bolt 76 for pivotal movement between a position, shown in FIG. 9, in which upper leg portion 70*a* and bolt 72 extend over plate 56, and a position in which the upper leg portion 70*a* and bolt 72 do not project over cover plate 56 or over top edge 52*b* of upper separator section 52. To secure cover plate 56 on upper separator section 52, the hooks 70 of the clamping assemblies 64 are pivoted away from edge 52*b*, and then the cover plate is simply placed on that top edge. Then, the hooks 70 of the clamping assemblies 64 are pivoted so that the top leg portions 70*b* of the hooks 70 extend over the cover plate 56, and then clamping bolts 72 are threaded downward through the upper leg portions and into a secure, tight pressure fit against the cover plate, as shown in FIG. 9, securing the cover plate to upper separator section 52. A resilient seal 80 may extend around section 52, at or immediately inside top edge 52*b* thereof to help develop an airtight seal between upper separator section 52 and cover plate 56 and to facilitate mounting and securing the cover plate on upper separator section.

In the operation of particle separator 36, the low pressure in the particle separator forces air and any foreign particles in containers 40 to pass through lines 20 and 22 and into the particle separator, and these particles and air enter the separator 36 along a direction tangential to separator section 52; and then particles and air tend to move around the interior of separator, against section 52. Because of their relatively heavy weight, the particles also tend to move downward in the particle separator 36 and eventually pass outward therefrom through outlet 60; while because of its relatively lighter weight, the air conducted into the particle separator tends to move upward and pass outward therefrom through air outlets 56*a* and 56*b*.

With reference again to FIG. 1, any suitable means 12 may be employed to produce or to supply the desired high pressure air and, likewise, any suitable means 30 may be used to provide the desired low pressure source. For example, means 12 may comprise a pump or simply a container holding a supply of air at an elevated pressure, and means 30 may comprise a pair of vacuum pumps connected to particle separator 36 via lines 24 and 26. In addition, in the operation of system 10, high pressure air may be continuously conducted through lines 14 and 16, and air may be continuously drawn from caps 32 and 34 via lines 20 and 22. Alternatively, high pressure air may be supplied through lines 14 and 16 and air may be drawn through lines 20 and 22 at discrete intervals. For example, air may be conducted through lines 14 and 16 at intervals coinciding with the movement of containers 40 beneath caps 32 and 34.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. Apparatus for extracting particles from containers, comprising:

a conveyor for continuously carrying the containers along a predetermined path in a given direction;

cap means extending directly above said predetermined path;

a source of pressurized air;

a high pressure line connected to said source and to the cap means to conduct the pressurized air to the cap means and to the containers to loosen the particles from the containers, the high pressure line including a downwardly extending outlet portion to conduct the high pressure air generally downward and into the containers;

a low pressure source;

a low pressure line connected to the cap means to connect the containers to the low pressure source to withdraw air and the particles from the containers, the low pressure line including an inlet connected to an upper portion of the cap means to draw air and particles generally upwardly from the containers; and a particle separator connected to the low pressure line, and disposed in series between the cap means and the low pressure source, to receive air and particles from the containers and to separate the particles from said received air before the received air passes to the low pressure source; and wherein in said given direction, the outlet of the high pressure line is forward of the inlet of the low pressure line so that each container passes directly below the outlet portion of the high pressure line before the container passes directly below the inlet of the low pressure line.

2. Apparatus according to claim 1, wherein the particle separator includes a first outlet to discharge the particles from the separator, and a second outlet to discharge from the separator air received from the containers.

3. Apparatus according to claim 2, wherein the low pressure source includes a vacuum pump connected to the second outlet of the particle separator to draw air out therefrom.

4. Apparatus according to claim 3, wherein:

the particle separator is a cyclone-gravity separator including a cylindrically shaped section;

the second outlet is located in an upper portion of the particle separator;

the first outlet is located in a lower portion of the particle separator; and the low pressure line is connected to said cylindrically shaped section, substantially tangential thereto.

5. Apparatus according to claim 1, wherein the containers move along a predetermined path extending below the cap means, and further including:

a pair of baffles extending downward from the cap means on first and second lateral sides of the predetermined path to help enclose the containers as the containers move past the cap means; and means releasably connecting the baffles to the cap means.

6. Apparatus according to claim 1, wherein:

the cap means includes a side wall having a general shape of a truncated cone, said truncated cone having a horizontal cross-section having an approximately elongated elliptical shape;

the inlet of the low pressure line is connected to the side wall of the cap means at a location slightly rearward of a center of said elongated elliptical shape; and the outlet portion of the high pressure line extends downward inside said side wall at a location slightly forward of the center of said elongated elliptical shape.

* * * * *